US005165053A

United States Patent [19]

Jones

[11] Patent Number: 5,165,053

[45] Date of Patent: Nov. 17, 1992

[54] ELECTRONIC LAMP BALLAST DIMMING CONTROL MEANS

[75] Inventor: William H. Jones, Villa Park, Ill.

[73] Assignee: Appliance Control Technology, Inc., Addison, Ill.

[21] Appl. No.: 814,768

[22] Filed: Dec. 30, 1991

[51] Int. Cl.[5] ..... H05B 41/391

[52] U.S. Cl. ..... 315/224; 315/226; 315/282; 315/307; 315/DIG. 4; 315/DIG. 5

[58] Field of Search ..... 315/209 R, 224, 291, 315/307, 281, DIG. 4, 282, DIG. 5, 226, DIG. 7; 331/36 R, 36 L, 65, 113 A, 181; 334/4, 17, 27

[56] References Cited

U.S. PATENT DOCUMENTS

| | | | |
|---|---|---|---|
| 2,915,637 | 12/1959 | McAdam | 331/113 A |
| 4,286,195 | 8/1981 | Swinen, Jr. | 315/224 |
| 4,558,262 | 12/1985 | Longenderfer et al. | 315/307 |
| 4,568,870 | 2/1986 | Chikuma | 323/326 |
| 4,792,729 | 12/1988 | Peters | 315/200 R |
| 4,937,504 | 6/1990 | Black, Jr. et al. | 315/307 |
| 4,950,963 | 8/1990 | Sievers | 315/360 |
| 4,994,718 | 2/1991 | Gordin | 315/240 |
| 4,998,046 | 3/1991 | Lester | 315/209 R |
| 5,004,959 | 4/1991 | Nilssen | 315/291 |

*Primary Examiner*—David Mis
*Attorney, Agent, or Firm*—Robert J. Black

[57] ABSTRACT

An electronic ballast including a dimming circuit for use with fluorescent lamps. An electromagnet located adjacent to a dual toroid coil transformer employed as part of a inverter circuit is used to control the saturation of the toroid coil to the control the on and off times of transistors included in the inverter circuitry, to limit saturation thereby controlling the intensity of the light emitted from the fluorescent lamps.

4 Claims, 1 Drawing Sheet

ELECTRONIC LAMP BALLAST DIMMING CONTROL MEANS

BACKGROUND OF THE INVENTION

1. Field of the Invention

The present invention relates to fluorescent lamp ballasts and more particularly to apparatus for controlling the power level generated so the amount of produced illumination may be varied from full brightness down to no light at all.

2. Background Art

The control of the brightness of illuminating systems is well known and is relatively simple particularly for incandescent lights. On the other hand, fluorescent lights, while more economic to operate than incandescent lamps cannot be controlled by simple rheostat type devices. The control of dimming for fluorescent lamps typically employs special and much more costly and sophisticated ballasts in conjunction with other circuitry to achieve illumination intensity control.

A number of patents have been discovered which disclose the dimming of fluorescent lamps. These include the following:

U.S. Pat. No. 4,286,195 to Swinea Jr. which teaches a fluorescent lamp dimming circuit limited to DC fluorescent lighting circuits with a type using a battary voltage source and an inverter. The DC input is interrupted by chopping up the current, thus the controls power the ballast by pulsive energy.

U.S. Pat. No. 4,558,262 to Longenderfer et al teaches a simple dimmer for use with a bank of ballasts and located ahead of the ballast itself, but not located within the ballast as is taught in the present invention.

U.S. Pat. No. 4,568,870 to Chikuma teaches the use of a phase control device for regulating the illumination of a fluorescent lamp. Again the dimmer is located ahead of the ballast in series therewith and employs a conventional triac incandescent lamp dimmer circuit. It is doubtful whether the circuit will properly operate, since when dimming occurs the bimetal start switch would cause the lamp to flash on and off.

U.S. Pat. No. 4,792,729 to Peters teaches a load side phase control circuit in conjunction with the conventional fluorescent light ballast with an isolation transformer to achieve fluorescent lamp brightness control. A resistor and capacitor connected in series shunt the phase control circuit to maintain low level illumination when the phase control circuit is non-conducting.

U.S. Pat. No. 4,937,504 to Black, Jr. et al teaches a time delay circuit for start up of a ballast. It obviously is intended for use with a dimmer unit located ahead of the ballast but not built within the ballast itself as taught by the present invention.

U.S. Pat. No. 4,950,963 to Sievers again teaches a device located ahead of the ballast rather than within as in the present invention, but employs a triac dimmer with a timer to disable the dimmer on startup.

U.S. Pat. No. 4,994,718 to Gordin employs a capacitor in series with the ballast to reduce lamp voltage. By changing the value of the capacitor a certain amount of dimming is achieved. Again the capacitor is not included within the ballast circuitry but rather is located between the ballast and the lamp. It is doubtful whether this circuitry would be operable at low light levels.

U.S. Pat. No. 4,998,046 to Lester employs variable pulse modulation to control the dimming by including a separately powered constant voltage filament arrangement. In practice it becomes necessary to increase the filament voltage as the light level decreases to make up for the loss in arc current. The requirement for a constant filament voltage would probably be very expensive and of questionable operational value.

U.S. Pat. No. 5,004,959 to Nilssen teaches a modified ballast for gas discharge lamps wherein the lamp current control means are utilized to vary the current magnetic flux saturation and in response to the magnetic flux applied controls the frequency of the AC voltage. It indicates that the lamp operating current supplied is dependent on the frequency of the alternating current voltage. It is stated in this patent that the magnetic flux means is magnetically coupled with the charge and control means adapted to provide control of magnetic flux to the control means to permit control of the frequency of the AC voltage and thereby the magnitude of the lamp operating current.

A careful review of the teachings of this patent indicates that the collector current of the transistor varies with dimming and the width of the current pulse decreases with an increase in dimming, and that the frequency only increases slightly. It is not the frequency but rather the duration of the pulse that determines the light level of the associated fluorescent lamp. For example, at 100% light level it has been determined that the transistors are conductive 76% of the time and at 10% of the light level they are conductive only 64% of the time. This change in duty cycle of transistors doesn't explain why the lamp goes from 100% down to a very light output level. The reason appears that the lamp impedance increases as the energy to the lamp decreases. Thus, it has been determined that in the circuitry as shown the lamp resistance changes with dimming and will significantly affect the total circuits electrical characteristics. A minor decrease in pulse width on time of the transistors will result in a large change of lamp output.

Accordingly, U.S. Pat. No. 5,004,959 cannot operate at a level of magnetic saturation that is significantly high. It becomes impossible to start a lamp unless the energy of the lamp is quite high. In most instances it is necessary to heat the gas quickly to achieve starting. Thus clearly the arrangement taught in U.S. Pat. No. 5,004,959 does not provide for positive starting and it becomes necessary to include a bypass circuit as taught in the present invention.

SUMMARY OF THE INVENTION

In many fluorescent electronic ballast units, a series tuned circuit arrangement is employed. In such an arrangement a dual toriod transformer is employed to switch on and off the two employed power transistors. The turns ratio utilized with the toriods controls the "on" time duty cycle of each power transistor. The "on" time in turn determines the amount of power permitted to flow into the fluorescent lamp.

Lamp current flowing through the primary of the toriods creates a magnetic field. As the current magnitude increases each cycle it will eventually drive the ferrite material of the toriods into saturation. This results in shut off of the power transistor to end that cycle. It is determined that the time for each ferrite to become saturated could be significantly affected if a secondary magnetic field is introduced. In effect, what occurs is the ferrite material in the toroids is initially partially saturated. The secondary DC field is created by employing an electromagnet. The electromagnet is so positioned that the secondary DC field from the electromagnet envelopes the toroids. As the strength of the DC field is increased from the electromagnet, the time required for the toroids to become saturated and to clamp off the power transistors decreases.

A variable DC current through the winding of the electromagnet is produced which varies the ampere-turn field strength of the electromagnet. This results in a variation of the lamp illumination level.

However, during the development of the dimming control circuit described above, it was determined that full dimming of the fluorescent lamp could not be provided. Only about a 50% reduction in illumination was available. If a greater amount of dimming was provided, the fluorescent lamp could not turn on again due to the fact that the arc voltage was reduced by the dimmer means. Thus, to ensure positive start-up the lamp required a minimum ignition voltage.

Accordingly, the present invention provides a means for starting that will always insure an adequate arc voltage. A simple economical solution employs a transistor to cut out a dimming limiting resistor after a predetermined timed delay. Accordingly, full arc voltage can then be applied to the fluorescent lamp for enough time to cause it to turn on.

DESCRIPTION OF THE PREFERRED EMBODIMENT

Figure 1:
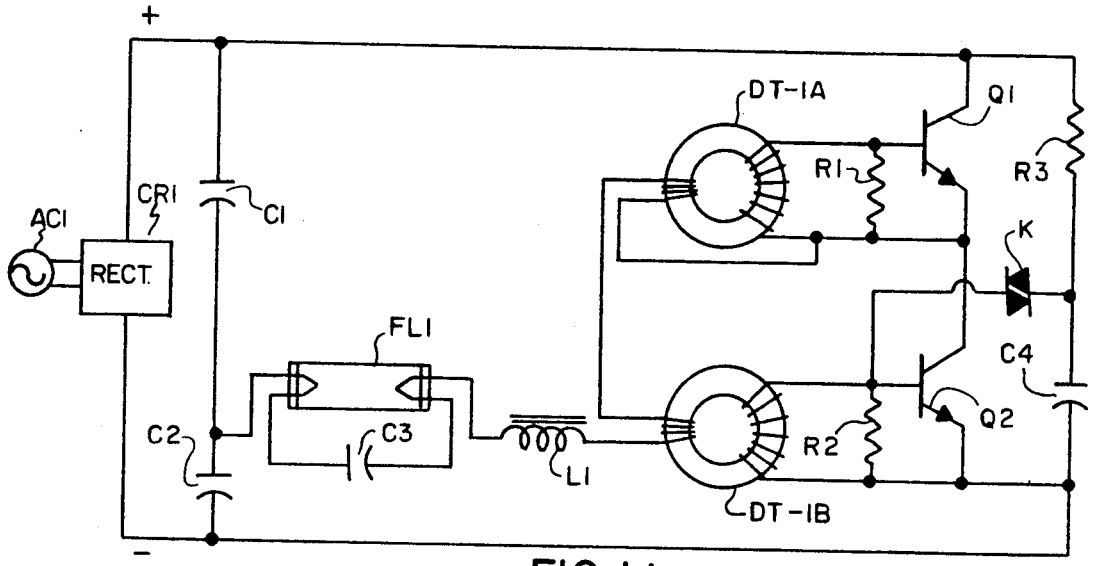
FIG. 1 (PRIOR ART)
FIG. 1 is a prior art series turned electronic ballast lamp for fluorescent lights employing dual toroids.

Referring now to prior art FIG. 1, an AC source AC1 usually 120 volts at 60 hertz is applied to full wave rectifier CR1. The output of which is applied directly between a +bus and a −bus with the positive voltage being connected to the +bus.

Between the +bus and the −bus are connected a series combination of two transistors Q1 and Q2 as well as a series combination of storage capacitors C1 and C2. The secondary winding of dual toroid DT-1A which functions as a current transformer is connected directly between the base and the emitter of transistor Q1. The secondary winding of toroid DT-1B is connected directly between the base and emitter of transistor Q2. The collector of transistor Q1 is connected directly with the positive bus while the emitter of transistor Q1 is connected directly to the collector of transistor Q2.

A first terminal of capacitor C1 is connected directly with the positive bus while the other terminal capacitor C1 is connected to capacitor C2. One terminal of capacitor C2 is connected directly with the negative bus while the other terminal as indicated is connected directly to capacitor C1. An inductor L1 and capacitor C3 are connected in series with one another and also with the primary windings of dual toroid transformers DT-1A and DT-1B. The same connection goes from the junction between capacitors C1 and C2 and extends through the filaments of fluorescent lamp FL1. Capacitor C3 is in parallel with lamp FL1. Thus base bias for transistor Q1 is provided by resistor R1, while that for transistor Q2 is provided by resistor R2.

The electromagnet EM consists of a coil of approximately 3,000 turns of 41AWG insulated copper magnet wire wound on a bobbin having dimensions 1.18 mlt and 0.035 A/W. A pole piece of 0.125" diameter with a face of 0.250" diameter is inserted through the bobbin center hole. A frame of plated steel completes the magnetic circuit and aids in intensifying the field strength immediately adjacent to dual toroids DT-1A and DT-1B.

Figure 2:
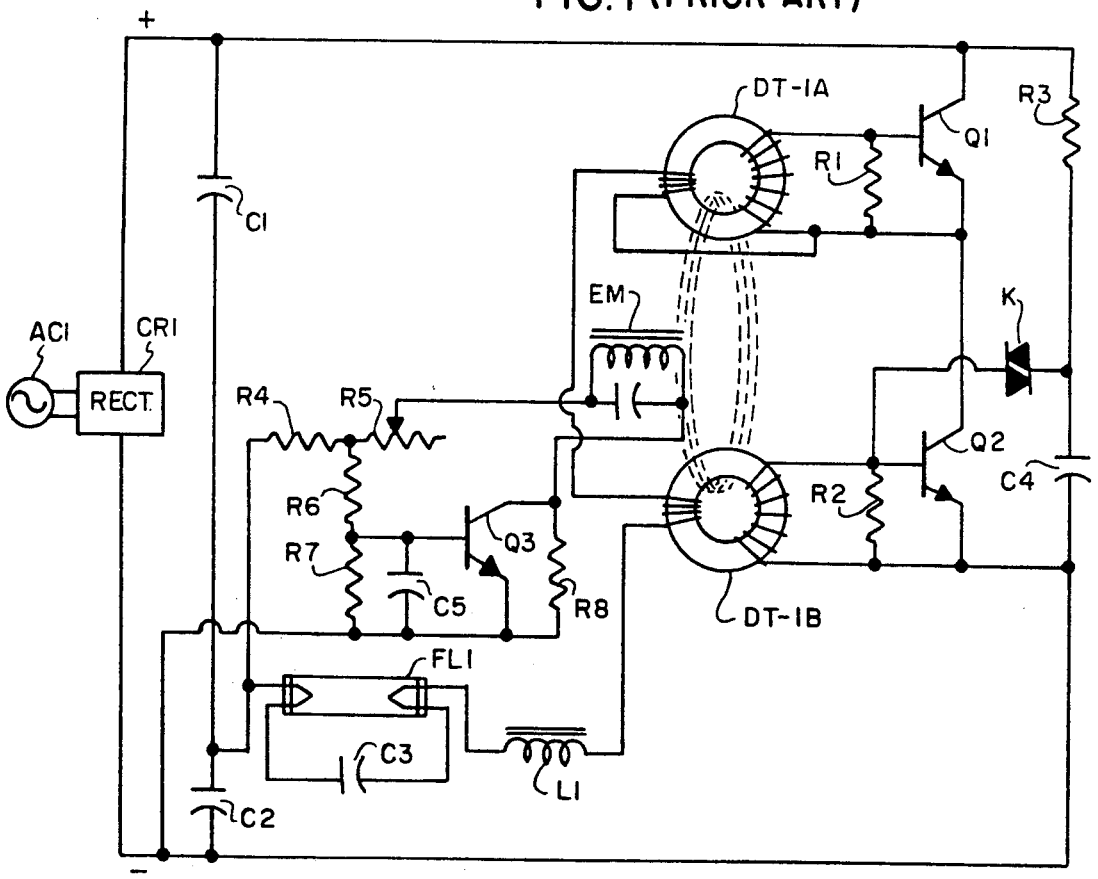
FIG. 2 is an electronic ballast unit providing dimming features and insured starting means in accordance with the present invention.

It has been found that DC current for coil EM can be produced in a number of ways. For example, a step down transformer can convert the usual 120 volt AC line to 30 volts AC. This lower voltage could be rectified and stored in 470 mf capacitor. By using a resistor of appropriate resistance values, any desired magnitude of current may be created. It is also possible to use in typical electronic ballasts the available DC power supply. During testing of the present invention, it was determined that approximately 30 milliamperes of current was sufficient to reduce the lamp power to off for a type F30T8-CW fluorescent lamp. Other size fluorescent lamps would require other resistance values. A resistor of about 275 ohms would create the requried shutdown current. A resistor of about 400 ohms would produce a 50% reduction in power of the lamp. As shown in FIG. 2, a variable resistor such as R5 can be employed to provide infinite light level adjustment. In the alternative by means of a switch or a number of switches a number of fixed dimming levels could also be created.

It was determined during testing that only about 50% reduction in illumination could be offered. If a greater amount of dimming was provided, by additional current to the electromagnet EM, the fluorescent lamp FL1 would not turn on again. As indicated before, this was because the arc voltage was reduced by the dimmer means. To ensure positive start up, the lamp required minimum ignition voltage.

On power up of the electronic ballast, transistor Q1 is normally in the off condition. Thus, resistor R8 is in series with the dimmer circuit consisting of the dimmer coil EM (the electromagnet), the potentiometer R5, and load resistor R4. Resistor R8 is of such a value that it will restrict the current flowing through the dimmer coil to a value equal to a high level of dimming. This will be true regardless of the setting of resistor R5. Without any significant DC field being generated by dimming coil EM, the switching toroids DT-1A and DT-1B in the ballast circuitry will produce a complete duty cycle on time of the power transistors Q1 and Q2. Full power will normally flow to a lamp FL1. After a delay of about one second, resistor R8 is by-passed by transistor Q3 being turned on. This results in the dimming circuit being connected as intended. Thus, if the dimmer at resistor R5 is set at some reduced level, the lamp FL1 will be appropriately dimmed. A resistor R6 in combination with capacitor T5 and resistor R7 are employed to form an RC time delay circuit. Initially the voltage on the base of transistor Q3 is zero. Transistor Q3 then is in the off condition. The voltage charge on capacitor C5 will slowly charge up through resistor R6. After approximately one second this charge will be high enough to cause transistor Q3 to turn on providing the appropriate path around resistor R8.

While but a single embodiment of the present invention has been shown, it will be obvious to those skilled in the art that numerous modifications may be made without departing from the spirit of the present invention which shall be limited only by the scope of the claims appended hereto.

What is claimed is:

1. An electronic ballast connected to a fluorescent lamp comprising:

an inverter circuit including connections to a direct current power source, for converting direct current to high voltage alternating current for operation of said fluorescent lamp;

said inverter circuit including first and second transistors and a dual toroid coil assembly functioning with said transistors to form said inverter circuit;

dimmer control means consisting of an electromagnet located in proximity to said dual toroid coil assembly;

said electromagnet connectable to said direct current power source;

and means for insuring starting of said fluorescent lamp comprising a third transistor connected in series with said electromagnet;

a time delay circuit connected to said third transistor;

said third transistor operated initially to inhibit operation of said electromagnet and after a predetermined period determined by said time delay circuit, further operated to connect said electromagnet to said direct current power source;

whereby said electromagnet is operated to control the saturation of said dual toroid assembly coil, said saturation determining the on and off times of said first and second transistors whereby said high voltage alternating current for operation of said fluorescent lamp is limited to control the intensity of light emitted therefrom.

2. An electronic ballast as claimed in claim 1 wherein: there is further included variable resistance means connected between said electromagnet and said direct current power source, operated to control the amount of saturation of said dual toroid coil assembly.

3. An electronic ballast as claimed in claim 1 wherein: said electromagnet consists of a coil of 3,000 turns of number 41 AWG insulated copper magnet wire on a bobbin with a polepiece of 0.125" diameter with a face of 0.25" diameter.

4. An electronic ballast as claimed in claim 3 wherein: said electromagnet further includes a frame of plated steel completing a magnetic circuit and aiding in intensifying the field strength of said electromagnet in the area immediately adjacent to said dual toroid coil assembly.

* * * * *